United States Patent [19]

Westernoff

[11] 4,335,876

[45] Jun. 22, 1982

[54] JOUSTING GAME

[76] Inventor: W. Gary Westernoff, 7538 Huialoha St., Honolulu, Hi. 96825

[21] Appl. No.: 153,068

[22] Filed: May 27, 1980

[51] Int. Cl.[3] ..... A63B 71/02; B62J 39/00

[52] U.S. Cl. ..... 273/1 R; 280/289 H

[58] Field of Search ..... 280/289 H, 447; 273/1 R, 85 R; 33/264; 272/33 B, 39

[56] References Cited

U.S. PATENT DOCUMENTS

| | | | |
|---|---|---|---|
| 914,656 | 3/1909 | Guerrant et al. | 46/47 |
| 2,208,049 | 7/1940 | Pajeau | 46/31 X |
| 2,667,720 | 2/1954 | Connell | 46/175 R |
| 3,222,066 | 12/1965 | Durrell | 273/85 R X |
| 3,336,048 | 8/1967 | Papucki | 280/289 H |
| 3,803,735 | 4/1974 | Stubbmann | 46/47 X |
| 3,942,822 | 3/1976 | Lewis | 280/289 R |
| 3,944,255 | 3/1976 | Martinson | 280/289 |

*Primary Examiner*—George J. Marlo
*Attorney, Agent, or Firm*—George W. T. Loo

[57] ABSTRACT

A jousting game which includes a number of ring support assemblies, a corresponding number of rings, and a jousting arm assembly. Jousting arm assembly includes a saddle clamp, a pivot mounting clamp, a jousting arm collar, a control lever, and a L-shaped jousting arm. Jousting arm collar is rotatably mounted at its central portion to the pivot mounting clamp. One end of the control lever is threadedly mounted to the top periphery of the jousting arm collar. One end of the L-shaped jousting arm is threadedly mounted to the periphery of the jousting arm collar at a predetermined distance from the top periphery. The jousting arm assembly is releasably mounted on the handle bar of a bicycle. The jousting arm of the jousting arm assembly may be elevated or depressed by a player by moving a control lever left or right, respectively. Each ring support assembly frictionally holds a ring and may be adjusted to change the height of the ring. The rings may be of different sizes and may be set at different heights within prescribed limits. Scoring is determined by the number and size of rings speared and retained by the jousting arm while the player is riding the bicycle along a prescribed course. The player with the highest final score is declared the winner. As an option, the amount of time required by the player to complete the course may be subtracted from the total score to determine the true score.

7 Claims, 16 Drawing Figures

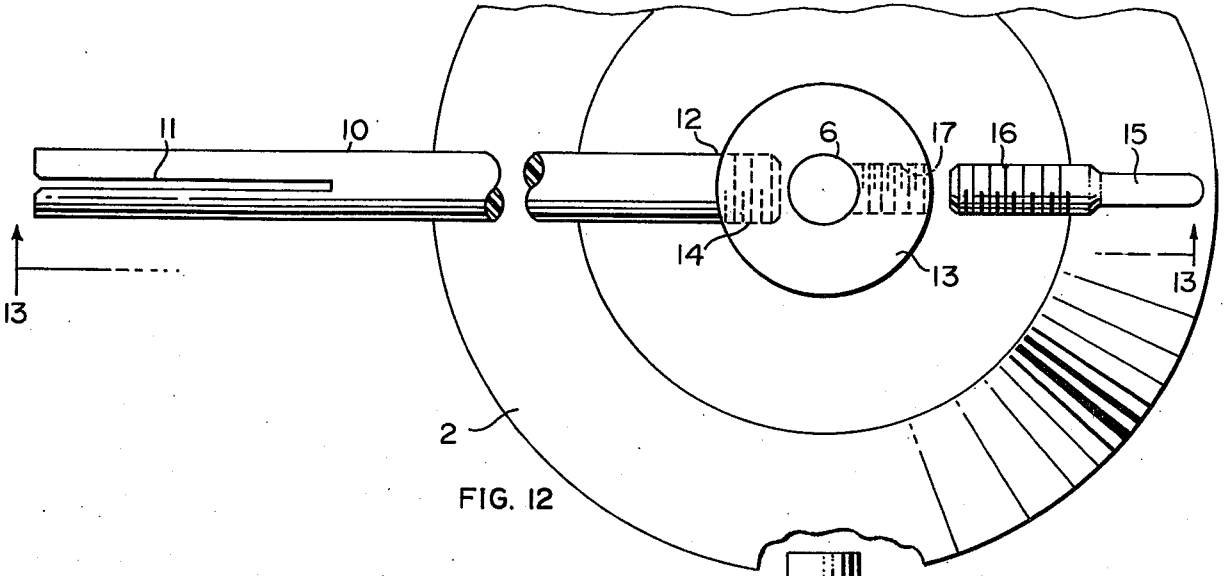
FIG. 12
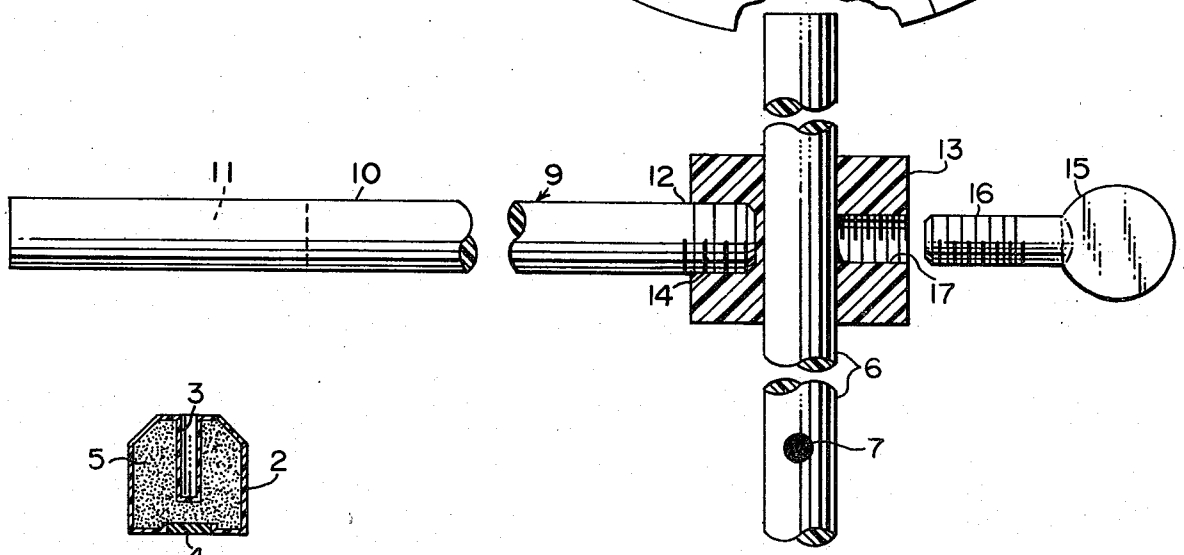
FIG. 13
FIG. 11
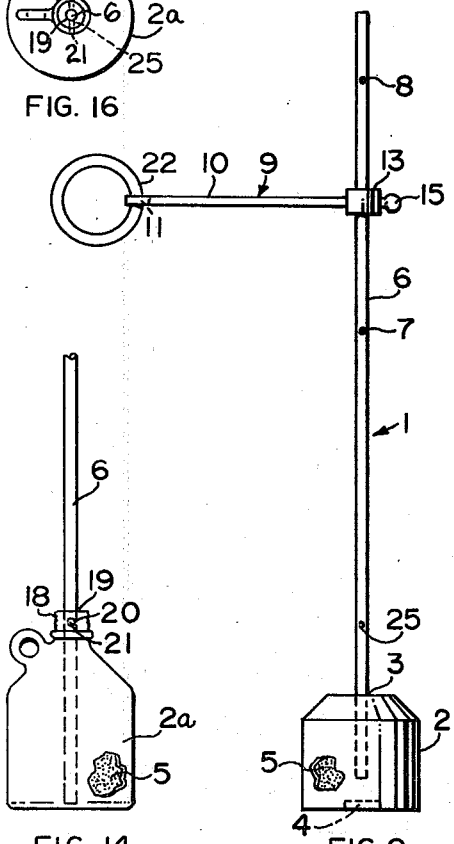
FIG. 9
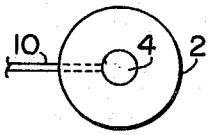
FIG. 10
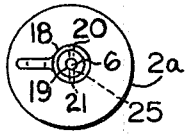
FIG. 16
FIG. 14
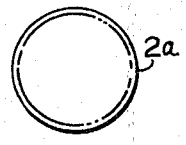
FIG. 15

JOUSTING GAME

BACKGROUND OF THE INVENTION

1. Field of Invention

This invention relates to a jousting game which uses a bicycle attachment to spear apertured targets.

2. Description of the Prior Art

At the present time apertured target games require a player to stand or sit while attempting to spear an apertured target. My invention makes the apertured target game more challenging by requiring the player to spear the apertured target while riding a bicycle.

3. Disclosure Statement

Connell, Jr., U.S. Pat. No. 2,667,720, dated Feb. 2, 1954, discloses a toy machine gun which is adapted to be mounted on a bicycle handle bar and which may be actuated and directed by a bicyclist. Simulated firing is obtained by moving a spring-like finger into engagement with the spokes of a bicycle wheel during its rotation, producing noises resembling the firing of a machine gun.

Durrell, U.S. Pat. No. 3,222,066, dated Dec. 7, 1965, discloses a game wherein a horse and rider with a spear moves around a circular track by means of a winding mechanism and moves up and down by means of a cam shaft grip operated by a player trying to spear rings on posts adjacent to the track. Scoring is determined by the number of rings speared and retained on the spear.

My invention utilizes a jousting arm, adapted to be mounted on a bicycle handle bar of a bicycle, to spear friction-held rings on a prescribed course. The jousting arm is operated up and down by means of a control lever moving left and right, respectively, by the player, while the bicycle is being propelled by the player along the prescribed course.

My invention is disclosed in document entitled "Disclosure Document", No. 089905, received in U.S. Patent and Trademark Office on Apr. 11, 1980.

SUMMARY OF THE INVENTION

This invention relates to a game wherein a bicycle attachment mounted on the handle bar of a bicycle is used to spear a number of frictionally supported rings located on a prescribed course.

An object of this invention is to provide a game wherein a jousting arm mounted on the handle bar of a bicycle is used to spear friction-held rings located on a prescribed course.

Another object of this invention is to provide a game which utilizes a bicycle attachment to spear rings held in slits of adjustable ring supports.

A further object of this invention is to provide a game of spearing various size diameter, friction-held rings with a jousting arm mounted on the handle bar of a bicycle.

Still another object of this invention is to provide a game wherein a bicyclist must adjust a jousting arm mounted on the handle bar of a bicycle up or down in order to spear friction-held rings located on a predetermined course.

A still further object of this invention is to provide a game of challenge, coordination, depth perception and skill.

Another object of this invention is to provide a game of skill which is simple in construction, durable, and inexpensive to manufacture.

A further object of this invention is to provide a game of skill wherein the scoring is determined by the number and size of friction-held rings speared from adjustable ring supports located on a prescribed course and retained on a bicycle attachment mounted on the handle bar of a bicycle when the player crosses the finish line on the bicycle.

Other objects, features and advantages of the present invention will be readily apparent from the following detailed description taken in connection with the accompanying drawings.

BRIEF DESCRIPTION OF THE DRAWINGS

FIG. 9 is a side elevational view of the ring support assembly.

FIG. 10 is a bottom plan view of the ring support assembly.

FIG. 11 is a cross-sectional view of the base of the ring support assembly.

FIG. 12 is an enlarged plan view of the ring support assembly.

FIG. 13 is a cross-sectional view of the collar with a front elevational view of the shaft, horizontal arm, and setscrew, looking in the direction of line 13—13 of FIG. 12.

FIG. 14 is a front elevational view of a modified base with the shaft in position.

FIG. 15 is a bottom plan view of the modified base.

FIG. 16 is a top plan view of the modified base with the shaft secured in position.

DESCRIPTION OF THE PREFERRED EMBODIMENT

Figure 2:
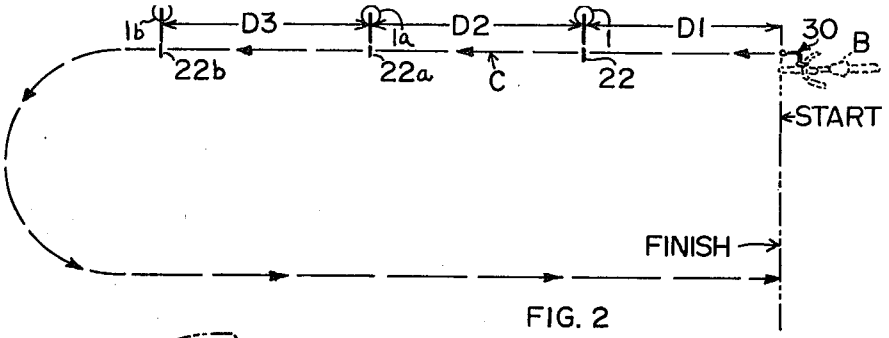
FIG. 2 is a plan view of a jousting course.
Figure 1:
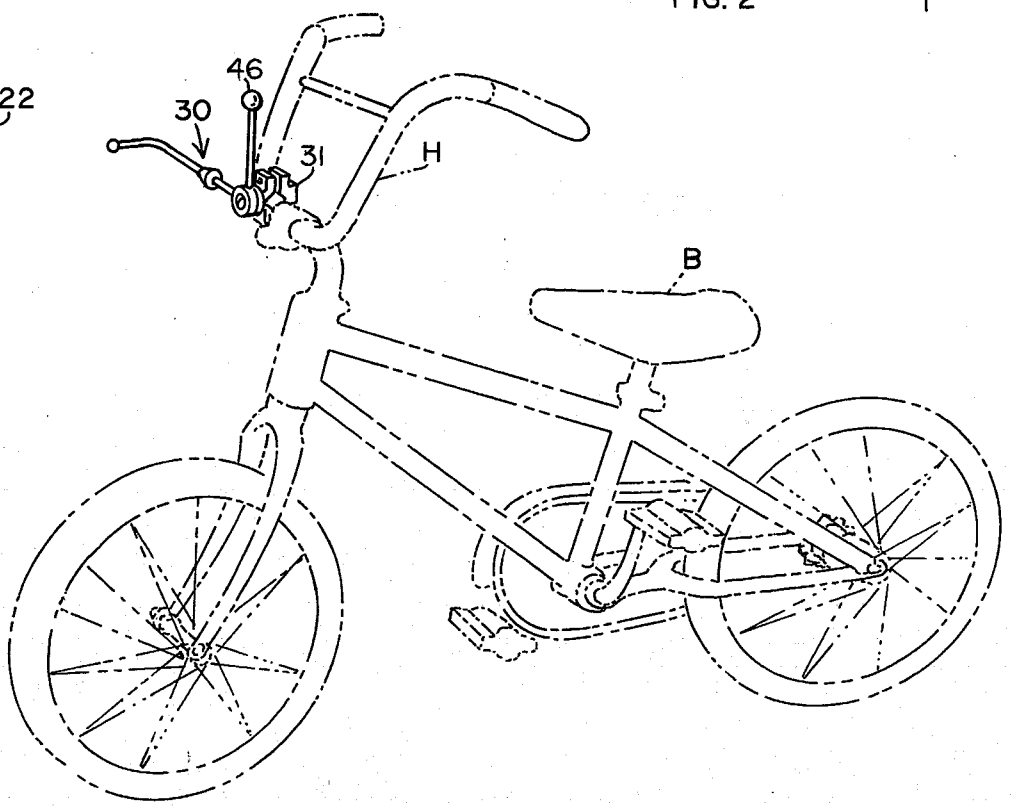
FIG. 1 is a perspective view of the invention.

Before explaining the present invention in detail it is to be understood that the invention is not limited in its application to the details of construction and arrangements of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference letters and numerals refer to like and corresponding parts throughout the several views, the preferred embodiment of the invention disclosed in FIGS. 1–13 inclusive includes a ring support assembly 1, rings 22, and a jousting arm assembly 30.

Ring support assembly 1 includes a base 2, a shaft 6, a horizontal arm assembly 9, an adjustment collar 13, and a setscrew 15. Base 2 has a shaft opening 3 in its top portion, a friction-type plug 4 in its bottom, and sand or other weighty material 5. Base 2 may be made of any suitable configuration such that the volume and appearance will closely relate to a one gallon plastic container with its top cut off. Shaft 6 has adjustment marks 7 and 8 located in its upper half and an opening 25 located in its lower half. Horizontal arm assembly 9 includes an arm 10 with a slit 11 on one end and a threaded end portion 12 on the other end. Adjustment collar 13 has a threaded opening 14 in its periphery and a threaded opening 17 in its periphery, in line with threaded opening 14. Setscrew 15 has a threaded end portion 16.

The lower portion of shaft 6 fits within shaft opening 3, with a location clearance fit. Threaded end portion 12 is threaded into threaded opening 14. Threaded end portion 16 is threaded into threaded opening 17 and against shaft 6 to lock horizontal arm assembly 9 at a selected height between adjustment marks 7 and 8.

Figure 3:
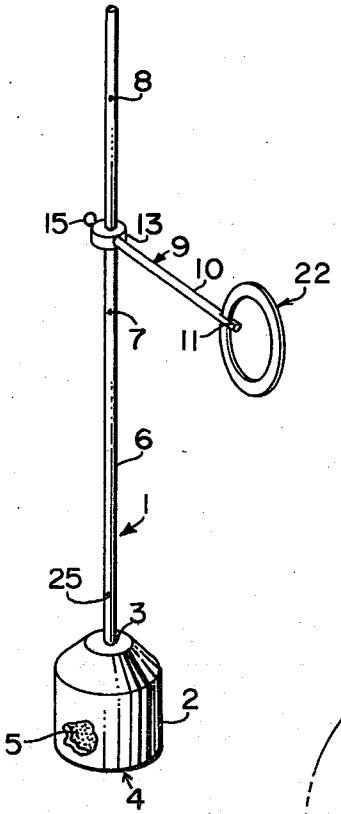
FIGS. 3–5 are plan views and front elevational views of different sized rings.
Figure 3:
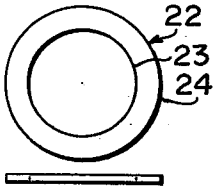
Figure 4:
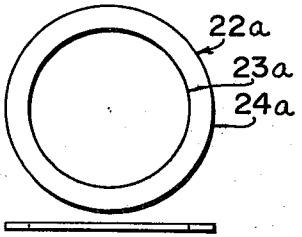
Figure 5:
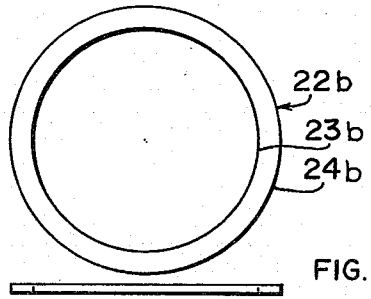
Figure 8:
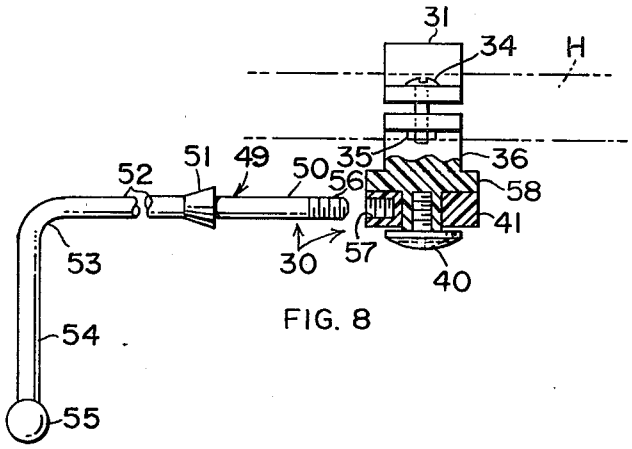
FIG. 8 is a top plan view of the pivot mounting clamp and jousting arm as shown in FIG. 6 with a partial cut-a-way view of the pivot mounting clamp.
Figure 7:
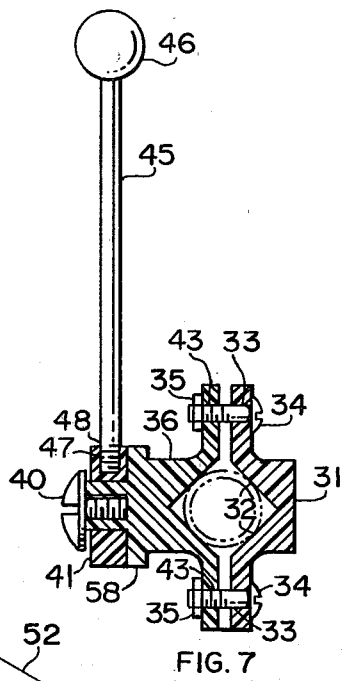
FIG. 7 is a sectional view taken on line 7—7 of FIG. 6.
Figure 6:
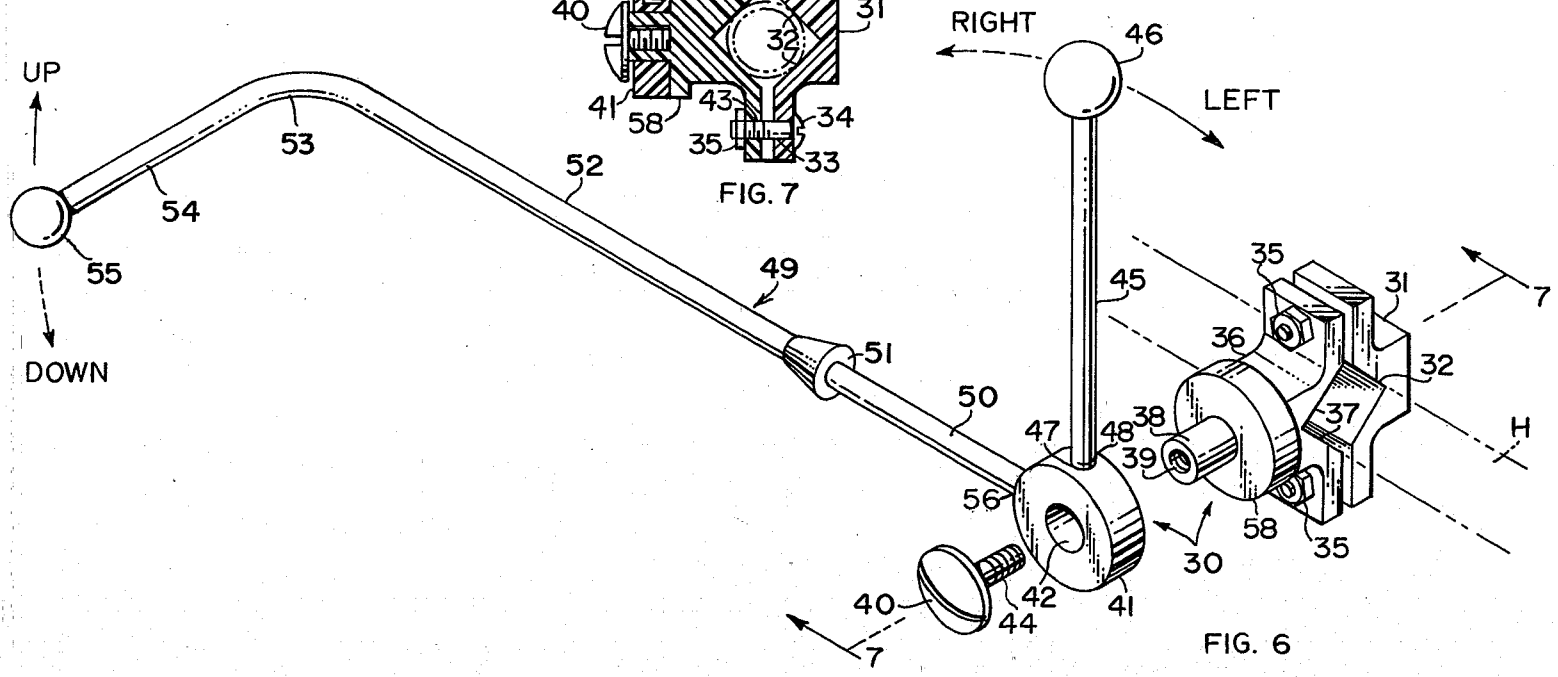
FIG. 6 is an exploded perspective view of the jousting arm assembly.

Rings 22, 22*a*, and 22*b* shown in FIGS. 3–5 are of three different sizes. Ring 22 is held in position within slit 11 by friction. Ring 22 has an inside diameter 23 and an outside diameter 24. Rings 22*a* and 22*b* have corresponding numbers with letters "a" or "b" to denote the respective parts on each of the rings.

Jousting arm assembly 30 includes a saddle clamp 31, screws 34, nuts 35, a pivot mounting clamp 36, screw 40, a jousting arm collar 41, a control lever 45, and a L-shaped jousting arm 49.

Saddle clamp 31 has a clamping area 32 and two threaded openings 33. Pivot mounting clamp 36 has a clamping area 37, a collar 58, a shaft 38, threaded shaft opening 39, and two threaded openings 43. Screw 40 has a threaded shaft 44. Jousting arm collar 41 has a central opening 42 and threaded openings 47 and 57 in its periphery. Control lever 45 has a ball handle 46 on one end and a threaded portion 48 on the other end.

Jousting arm 49 has a proximal portion 50 with a ring keeper 51 on one end and a threaded portion 56 on the other end, a medial portion 52 which is joined on one end to ring keeper 51 and on the other end to a bend 53, and a distal portion 54 which is joined on one end to bend 53 and on the other end to ball tip 55.

Threaded portion 48 is threaded into threaded opening 47. Threaded portion 56 is threaded into threaded opening 57. Shaft 38 is placed within central opening 42 so that collar 58 abuts jousting arm collar 41. Screw 40 is then threaded into threaded shaft opening 39 to maintain the touching relationship between collar 58 and jousting arm collar 41. The diameter of central opening 42 is slightly greater than the diameter of shaft 38 to provide a sliding fit between shaft 38 and central opening 42. This sliding fit relationship between shaft 38 and central opening 42 allows jousting arm collar 41 to pivot around shaft 38 when control lever 45 is moved left or right. When control lever 45 is moved left, ball tip 55 will move upward; when control lever 45 is moved right, ball tip 55 will move downward.

Jousting arm assembly 30 is mounted on the handle bar H of a bicycle B by placing the jousting arm assembly 30 so that handle bar H is between the clamping areas 32 and 37. Then passing screws 34 through the threaded openings 33 and 43 and threading nuts 35 onto screws 34 so that control lever 45 is in a vertical position and so that jousting arm assembly 30 is securely mounted on handle bar H of bicycle B.

My invention may be made of any suitable material. In my preferred embodiment, I have made base 2, adjustment collar 13, and ring 22 of acetal plastic. All other components except sand or other weighty material 5 are made of aluminum.

The rings are made in three sizes with inside diameters of 3", 4½" and 6" and material thickness of 1/16". Top of base 2 has a recessed shaft opeing 3, which is 3" deep to receive shaft 6. Bottom of base 2 has 2" diameter hole, which is plugged with a friction-type plug 4. Shaft 6 is approximately 42" high with a ½" diameter. Adjustment marks 7 and 8 are located on shaft 6 so that when jousting arm 49 is elevated or depressed within a range of positions, at least one position will be in line with ring 22 for spearing and removing ring 22 from ring support assembly 1. Arm 10 is 14" long with a ⅜" diameter. Hole 25 is ⅛" in diameter.

If desired, jousting arm collar 41, control lever 45, and jousting arm 49 may be manufactured as a single component instead of three components by forming and machining.

FIG. 2 shows a suggested jousting course C. Ring support assemblies 1, 1*a*, and 1*b* are placed at predetermined distances D1, D2, and D3 from the starting line and from each other. Rings 22, 22*a*, and 22*b* are placed into position on horizontal arm assemblies and are placed at various heights, within the limitations of adjustment marks 7 and 8. Jousting arm assembly 30 is mounted on the right handle bar of a bicycle B. Rings 22, 22*a*, and 22*b* are on the right side of bicycle B. A player will pedal bicycle B as shown by the arrows with the broken lines so that rings 22, 22*a*, and 22*b* will always be on the right side of bicycle B the player is approaching the rings. After passing ring support assembly 1*b*, the player will turn left and race back to the starting line which now becomes the finish line. From "Start" to "Finish" is classified as a single "run".

FIG. 14 shows a modified base 2*a*. Base 2*a* may be any plastic gallon container with a screw-type cap 18. An opening 19 is drilled in the center of cap 18 to receive shaft 6 and an opening 20 is drilled through cap 18 and base 2*a* at a height approximately 1" below the top of base 2*a* so that a nail or screw 21 may be placed through openings 20 and 25 to secure shaft 6 to base 2*a*. Sand or other weighty material 5 is placed in base 2*a* prior to securing shaft 6 to base 2*a*.

My invention may be played in the following manner: (1) A player stands alongside bicycle B at the starting line of jousting course C. (2) On a given signal the player mounts bicycle B and rides as fast and as safely as possible towards ring 22. (3) As the player approaches ring 22, he adjusts ball tip 55 up or down by grasping ball handle 46 and by moving control lever 45 left or right, respectively, so that ball tip 55 will be able to spear ring 22. (4) The player then spears or attempts to spear ring 22. As ring 22 is only held in slit 11 by frictional contact with its edges, ring 22 is readily removed by jousting arm 49 from slit 11. Ring 22 will now lay in position on jousting arm 49 and will be held in place by ring keeper 51. (5) The player then pedals bicycle B towards ring 22*a*. (6) While en route to ring 22*a*, he adjusts the level of ball tip 55 up or down by moving control lever 45 left or right, respectively, so that ball tip 55 will be in line with ring 22*a* for spearing. (7) The player then spears or attempts to spear ring 22*a*. (8) The player then pedals bicycle B towards ring 22*b*. (9) While en route to ring 22*b*, he adjusts the level of ball tip 55 up or down by moving control lever 45 left or right, respectively, so that ball tip 55 will be in line with ring 22*b* for spearing. (10) The player then spears or attempts to spear ring 22*b*. (11) The player then turns left and races back to the finish line.

Scoring is determined by the number and size of rings speared and retained on jousting arm 49 when the player crosses the finish line. Ring 22 equals 3 points, ring 22*a* equals 2 points, and ring 22*b* equals 1 point. The various ring sizes may be color coded, if desired.

Each player will make the same amount of runs of course C and the player with the highest final score is declared the winner.

Because rings 22, 22*a*, and 22*b* are placed at various heights within the limitations of adjustment marks 7 and 8, skill is required to spear the rings. Jousting arm 49 must be adjusted upward or downward by moving control lever 45 to the left or right, respectively, so that it will be in line with the ring for spearing and removing the ring from slit 11. Moreover, since the rings may be placed in any order, additional skill is required.

As an option, each run may be timed and scored. The final score is determined by totaling the value of the rings speared and retained and then subtracting from the total value the total time required to run the course.

My invention may be played by one or more players. It may be played with one ring and its support or with several rings and their supports placed approximately 30 to 40 feet apart with varying ring sizes and heights. It may be played on various shaped courses, such as FIG. 8 or circular. It may be played with cones and jumping ramps. Players may decide beforehand the course to be run, the rings to be used, the number of runs to be made by each player, and the scoring arrangements.

My invention will provide a game of skill, challenge, coordination, and depth perception. My invention will aid in quickening the eyes and reflexes of the players.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A jousting game comprising a jousting arm assembly which includes a jousting arm, means for elevating or depressing the jousting arm, and means for mounting the jousting arm assembly on the handle bar of a bicycle; the means for elevating or depressing the jousting arm includes a jousting arm collar with a central opening and two spaced threaded openings in its periphery, one at its top and the other at its side, and a control lever, one end of the control lever is threaded and is threadedly secured to the top peripheral opening, and one end of the jousting arm is threaded and is threadedly secured to the other peripheral opening.

2. The jousting game of claim 1, wherein the means for mounting the jousting arm assembly on the handle bar of a bicycle or the like includes a saddle clamp and a pivot mounting clamp, which are connected at their borders by securing means, the pivot mounting clamp has a collar with a circular shaft projecting therefrom, the circular shaft has a central threaded opening and slidingly fits within the central opening of the jousting arm collar, and the jousting arm collar and the collar of the pivot mounting clamp are secured in abutting relationship by other securing means.

3. The jousting game of claim 2 in combination with at least one ring support assembly and at least one ring, the ring is frictionally held by the ring support assembly and the height of the ring may be adjusted within prescribed limits.

4. The jousting game of claim 3, wherein the ring support assembly includes a base, a shaft, a horizontal arm assembly, an adjustment collar, and a setscrew, one end of the shaft fits within an opening in the base, the horizontal arm assembly includes an arm with a slit on one end and a threaded end portion on the other end, the horizontal arm assembly is secured to one side of the adjustment collar and the setscrew is threaded into the other side of the adjustment collar, the ring is frictionally held within the edges of the slit, two spaced adjustment marks are located on the upper half portion of the shaft.

5. The jousting game of claim 4, wherein the rings have different sized inner diameters.

6. The jousting game of claim 4, wherein a hole is located in the lower half portion of the shaft.

7. A jousting game comprising a jousting arm assembly which includes a jousting arm, means for elevating or depressing the jousting arm, and means for mounting the jousting arm assembly on the handle bar of a bicycle in combination with at least one ring support assembly and at least one ring, the ring support assembly includes means for frictionally holding the ring and means for adjusting the height of said support assembly.

* * * * *